US005868896A

United States Patent [19]

Robinson et al.

[11] Patent Number: 5,868,896

[45] Date of Patent: Feb. 9, 1999

[54] CHEMICAL-MECHANICAL PLANARIZATION MACHINE AND METHOD FOR UNIFORMLY PLANARIZING SEMICONDUCTOR WAFERS

[75] Inventors: Karl M. Robinson, Boise, Id.; Chris Chang Yu, Aurora, Ill.

[73] Assignee: Micron Technology, Inc., Boise, Id.

[21] Appl. No.: 743,704

[22] Filed: Nov. 6, 1996

[51] Int. Cl.[6] ..... B24B 1/00

[52] U.S. Cl. ..... 156/344; 156/584; 438/959; 451/289

[58] Field of Search ..... 156/344, 584, 156/153; 438/5, 14, 692, 959; 451/11, 24, 66, 289, 290, 334, 339

[56] References Cited

U.S. PATENT DOCUMENTS

| | | | |
|---|---|---|---|
| 4,356,055 | 10/1982 | Montier | 438/14 X |
| 4,884,941 | 12/1989 | Kazerooni | 451/11 X |
| 5,185,957 | 2/1993 | Mizuguchi et al. | 451/11 |
| 5,240,552 | 8/1993 | Yu et al. | 438/5 |
| 5,329,732 | 7/1994 | Karlsrud et al. | 451/289 |
| 5,498,199 | 3/1996 | Karlsrud et al. | 451/289 |

*Primary Examiner*—James Engel

*Attorney, Agent, or Firm*—Seed & Berry LLP

[57] ABSTRACT

An apparatus and method for uniformly planarizing a surface of a semiconductor wafer and accurately stopping CMP processing at a desired endpoint. In one embodiment, a planarizing machine has a platen mounted to a support structure, an underpad attached to the platen, a polishing pad attached to the underpad, and a wafer carrier assembly. The wafer carrier assembly has a chuck with a mounting cavity in which the wafer may be mounted, and the wafer carrier assembly moves the chuck to engage a front face of the wafer with the planarizing surface of the polishing pad. The chuck and/or the platen moves with respect to the other to impart relative motion between the wafer and the polishing pad. The planarizing machine also includes a pressure sensor positioned to measure the pressure at an area of the wafer as the platen and the chuck move with respect to each other and while the wafer engages the planarizing surface of the polishing pad. The pressure sensor generates a signal in response to the measured pressure that corresponds to a planarizing parameter of the wafer. In a preferred embodiment, the planarizing machine further includes a converter operatively connected to the pressure sensor, a controller operatively connected to the converter, and a plurality of drivers operatively connected to the controller and positioned in the mounting cavity.

19 Claims, 8 Drawing Sheets

CHEMICAL-MECHANICAL PLANARIZATION MACHINE AND METHOD FOR UNIFORMLY PLANARIZING SEMICONDUCTOR WAFERS

TECHNICAL FIELD

The present invention relates to chemical-mechanical planarization of semiconductor wafers, and more particularly, to a chemical-mechanical planarization machine that locally adjusts the contour of the wafer to enhance the uniformity of the planarized surface on the wafer.

BACKGROUND OF THE INVENTION

Chemical-mechanical planarization ("CMP") processes remove material from the surface of a semiconductor wafer in the production of integrated circuits. FIG. 1 schematically illustrates a CMP machine 10 with a platen 20, a wafer carrier 30, a polishing pad 40, and a planarizing liquid 44 on the polishing pad 40. The polishing pad 40 may be a conventional polishing pad made from a continuous phase matrix material (e.g., polyurethane), or it may be a new generation fixed abrasive polishing pad made from abrasive particles fixedly dispersed in a suspension medium. The planarizing liquid 44 may be a conventional CMP slurry with abrasive particles and chemicals that etch and/or oxidize the wafer, or the planarizing liquid 44 may be a planarizing solution without abrasive particles that contains only chemicals to etch and/or oxidize the surface of the wafer. In most CMP applications, conventional CMP slurries are used on conventional polishing pads, and planarizing solutions without abrasive particles are used on fixed abrasive polishing pads.

The CMP machine 10 also has an underpad 25 attached to an upper surface 22 of the platen 20 and the lower surface of the polishing pad 40. In one type of CMP machine, a drive assembly 26 rotates the platen 20 as indicated by arrow A. In another type of CMP machine, the drive assembly reciprocates the platen back and forth as indicated by arrow B. Since the polishing pad 40 is attached to the underpad 25, the polishing pad 40 moves with the platen 20.

The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier, or an actuator assembly 36 may be attached to the wafer carrier to impart axial and/or rotational motion (indicated by arrows C and D, respectively).

To planarize the wafer 12 with the CMP machine 10, the wafer carrier 30 presses the wafer 12 face-downward against the polishing pad 40. While the face of the wafer 12 presses against the polishing pad 40, at least one of the platen 20 or the wafer carrier 30 moves relative to the other to move the wafer 12 across the planarizing surface 42. As the face of the wafer 12 moves across the planarizing surface 42, the polishing pad 40 and the planarizing liquid 44 continually remove material from the face of the wafer 12.

CMP processes must consistently and accurately produce a uniform, planar surface on the wafer to enable precise circuit and device patterns to be formed with photolithography techniques. As the density of integrated circuits increases, it is often necessary to accurately focus the critical dimensions of the photo-patterns to within a tolerance of approximately 0.1 $\mu$m. Focusing photo-patterns of such small tolerances, however, is difficult when the planarized surface of the wafer is not uniformly planar. Thus, CMP processes must create a highly uniform, planar surface.

One problem with CMP processing is that the planarized surface of the wafer may not be sufficiently uniform across the whole surface of the wafer. The uniformity of the planarized surface is a function of the distribution of slurry under the wafer, the relative velocity between the wafer and the polishing pad, the contour and condition of the polishing pad, the topography of the front face of the wafer, and several other CMP operating parameters. In fact, because the uniformity of the planarized surface is affected by so many different operating parameters, it is difficult to determine and correct irregularities in specific operating parameters that adversely affect the uniformity of a given processing run of semiconductor wafers. Therefore, it would be desirable to develop a CMP machine and process that compensates for irregular operating parameters to enhance the uniformity of finished wafers.

In the competitive semiconductor industry, it is also desirable to maximize the throughput of finished wafers. One factor that affects the throughput of CMP processing is the ability to accurately stop planarizing a given wafer at a desired endpoint. To determine whether a wafer is at its desired endpoint, conventional CMP processes typically stop planarizing the wafer and measure the change in thickness of the wafer with an interferometer or other distance measuring device. If the wafer is under-planarized, CMP processing is resumed and the wafer is periodically measured until the wafer reaches its desired endpoint. If the wafer is over-planarized, the wafer may be partially or fully damaged. The throughput of finished wafers is accordingly greatly affected by the ability to accurately and quickly determine the endpoint of a specific wafer. Therefore, it would be desirable to develop a CMP machine and process that determines the endpoint of a wafer without stopping CMP processing.

SUMMARY OF THE INVENTION

The present invention is a planarizing machine and method for uniformly planarizing a surface of a semiconductor wafer and accurately stopping CMP processing at a desired endpoint. In one embodiment, a planarizing machine for removing material from a semiconductor wafer has a platen mounted to a support structure, an underpad attached to the platen, a polishing pad attached to the underpad, and a wafer carrier assembly. The wafer carrier assembly has a chuck with a mounting cavity in which a wafer may be mounted, and the wafer carrier assembly moves the chuck to engage a front face of the wafer with the planarizing surface of the polishing pad. The chuck and/or the platen move with respect to each other to impart relative motion between the wafer and the polishing pad. The planarizing machine also has a pressure sensor positioned to measure the pressure at an area of the wafer as the platen and/or the chuck move and while the wafer engages the planarizing surface of the polishing pad. The pressure sensor is preferably one or more piezoelectric sensors positioned in either the underpad, the polishing pad, or the mounting cavity of the chuck. The pressure sensor generates a signal in response to the measured pressure that corresponds to a planarizing parameter of the wafer.

In a preferred embodiment, the planarizing machine further includes a converter operatively connected to the pressure sensor and a controller operatively connected to the converter. The converter transposes an analog signal from the pressure sensor into a digital representation of the measured pressure, and the controller controls an operating parameter of the planarizing machine in response to the digital representation of the measured pressure.

In one particular embodiment of the invention, the planarizing machine further comprises a plurality of actuators operatively connected to the controller and positioned in the mounting cavity of the chuck to act against the backside of the wafer. The pressure sensor is preferably positioned in either the underpad or the polishing pad so that the wafer passes over the pressure sensor. In operation, the pressure sensor generates a signal corresponding to the contour of the front face of the wafer, and the controller selectively drives each actuator toward or away from the backside of the wafer to selectively deform the wafer in response to the measured contour of the front face.

In still another particular embodiment of the invention, the pressure sensor is a piezoelectric stress sensor that is positioned in the mounting cavity of the chuck and releasably adhered to the backside of the wafer. The stress sensor measures torsional stress across an area of the backside of the wafer and generates a signal corresponding to the measured stress. It is expected that changes in stress will indicate an endpoint of the wafer. In operation, the controller stops the planarization process when the measured stress indicates that the wafer is at a desired endpoint.

DETAILED DESCRIPTION OF THE INVENTION

The present invention is a planarizing machine and method for uniformly planarizing a wafer and accurately stopping CMP processing at a desired endpoint. An important aspect of an embodiment of the invention is to measure the pressure at areas along the wafer to determine the contour of the front face of the wafer or its thickness while it is being planarized. One discovery of the present invention is that the pressure between the wafer and the polishing pad is expected to be proportional to the contour of the front face of the wafer. Another discovery of the present invention is that the torsional stress in the wafer is expected to indicate an endpoint of the wafer. Accordingly, by measuring the pressure at areas along the wafer while it is being planarized, the present invention provides an indication of the contour of the front face of the wafer and/or its endpoint without interrupting the CMP process. Another important aspect of an embodiment of the present invention is to control an operating parameter in response to the measured pressure. More specifically, the present invention selectively deforms the wafer to more uniformly planarize the surface of the wafer. Also, the present invention is expected to accurately stop the CMP process at a desired endpoint of the wafer without removing the wafer from the polishing pad or otherwise interrupting the planarizing process. FIGS. 2–9, in which like reference numbers refer to like elements and features throughout the various views, illustrate embodiments of chemical-mechanical planarization machines and the processes of using those machines in accordance with the invention.

Figure 1:
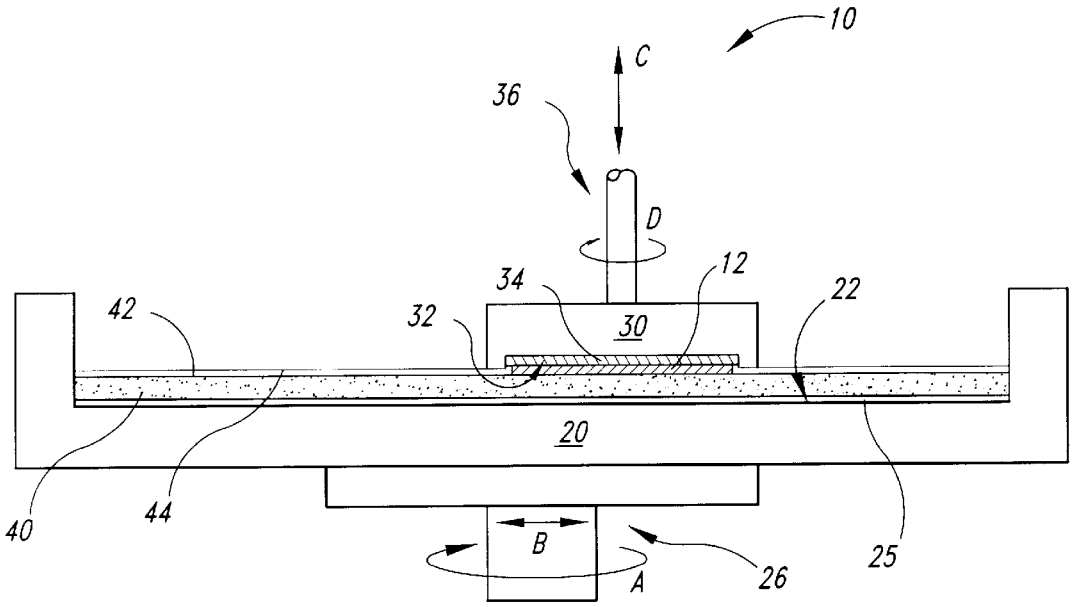
Fig. 1 (PRIOR ART)
FIG. 1 is a schematic cross-sectional view of a chemical-mechanical planarization machine in accordance with the prior art.
Figure 2:
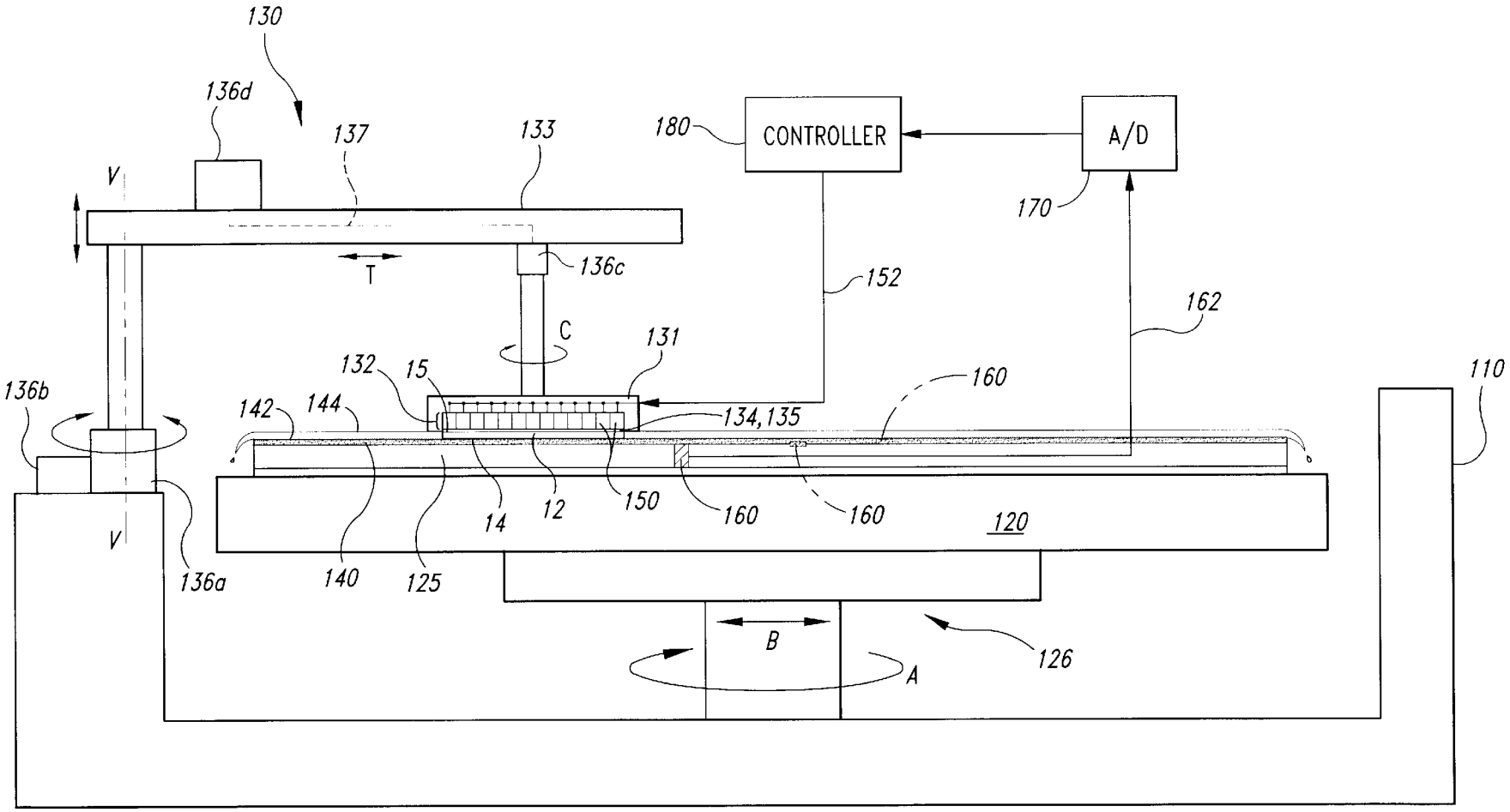
FIG. 2 is a schematic cross-sectional view of an embodiment of a chemical-mechanical planarization machine in accordance with the invention.

FIG. 2 illustrates a CMP machine 110 for measuring the pressure between a wafer 12 and a polishing pad 140 to determine and control the contour of a front face 14 of the wafer 12. As discussed above with respect to FIG. 1, the CMP machine 110 has a platen 120, an underpad 125 mounted to the top surface of the platen 120, and a polishing pad 140 mounted to the top surface of the underpad 125.

The CMP machine 110 also has a wafer carrier assembly 130 positionable over the polishing pad 140 to engage the front face 14 of the wafer 12 with a planarizing surface 142 of the polishing pad 140 in the presence of a planarizing solution 144. The wafer carrier assembly 130 preferably has a chuck 131 attached to an arm 133, and a number of cylinders and motors 136(*a*)–136(*d*) connected to the chuck 131 and the arm 133. A cylinder 136(*a*) may be attached to one end of the arm 133 to move the arm 133 vertically along an axis V—V with respect to the polishing pad 140, and a motor 136(*b*) may be connected to the cylinder 136(*a*) to rotate the cylinder 136(*a*) and the arm 133 about the axis V—V. Additionally, another motor 136(*c*) is preferably connected to the chuck 131 to rotate the chuck 131 in the direction of arrow C, and another actuator 136(*d*) is preferably operatively coupled to the chuck 131 by a connector 137. The actuator 136(*d*) and the connector 137 translate the chuck 131 along the longitudinal axis of the arm 133 (shown by arrow T).

Figure 3:
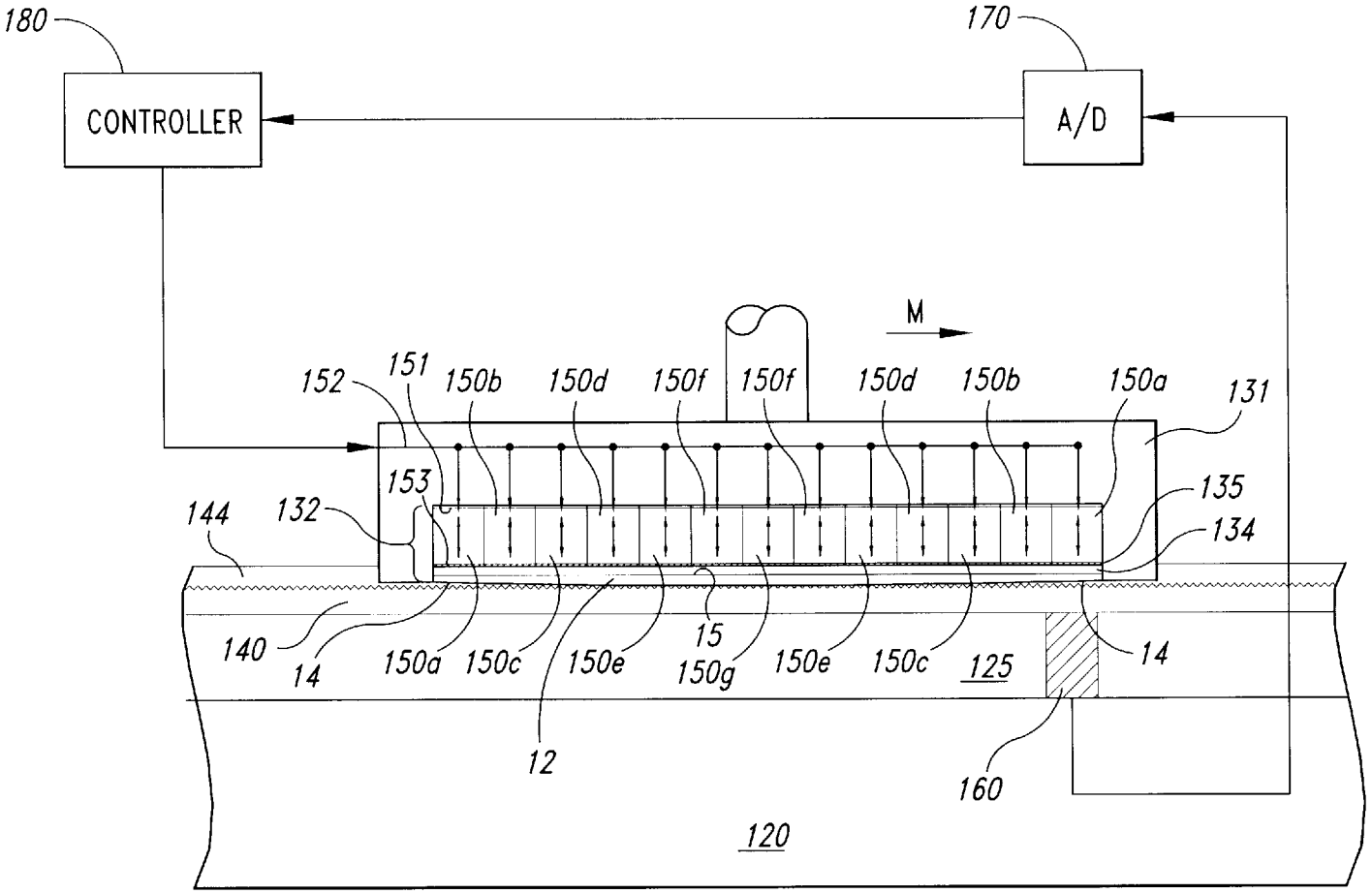
FIG. 3 is a partial schematic cross-sectional view of an embodiment of a wafer carrier assembly of a chemical-mechanical planarization machine in accordance with the invention.

With reference, also, to FIG. 3, the chuck 131 has a mounting socket 132 in which a number of linear actuators 150 are positioned to act upon a backside 15 of the wafer 12. The actuators 150 are preferably piezoelectric actuators that expand and contract vertically in proportion to an electrical signal. Suitable piezoelectric actuators are the ESA devices manufactured by Newport of Irvine, Calif. In a preferred embodiment, a backing pad 134 (best shown in FIG. 3) and a deformable plate 135 (best shown in FIG. 3) are positioned between the actuators 150 and the backside 15 of the wafer 12 to control the friction between the wafer 12 and the chuck 131, and to control the extent that the wafer 12 is deformed by the actuators 150. The backing pad 134 is preferably a DF200 pad manufactured by Rodel Corporation of Newark, Del., and the deformation plate 135 is preferably a relatively stiff plate made from stainless steel, fiberglass, or rigid materials. Depending upon the rigidity of the material and the specific CMP application, the deformable plate 135 generally has a thickness of between 5 and 25 mm.

The planarizing machine 110 also includes a pressure sensor 160 positioned to measure the pressure at areas across the wafer 12. The pressure sensor 160 is preferably a piezoelectric pressure sensor positioned in the underpad 125 so that the wafer 12 passes over the pressure sensor 160 during planarization. In alternative embodiments (shown in phantom), the pressure sensor 160 may be positioned in the polishing pad 140 or between the underpad 125 and the polishing pad 140. To position the pressure sensor 160 in either the underpad 125 or the polishing pad 140, the pressure sensor 160 is preferably placed in a hole with a size and shape corresponding to the particular shape of the sensor. The pressure sensor 160 is coupled to an analog-to-digital converter 170 by a line 162, which may be an electrical, light, or acoustical conduit that transmits an analog signal generated by the pressure sensor 160 to the A/D converter 170. The A/D converter 170 transforms the analog signal from the pressure sensor 160 to a digital signal that may be manipulated by a processor. Suitable converters 170 are manufactured by Texas Instruments of Dallas, Tex.

The A/D converter 170 is operatively connected to a controller 180, which receives and processes the digital signal from the A/D converter 170. The controller 180 correlates the signals from the A/D converter 170 with the position of the wafer 12 as the wafer 12 passes over the pressure sensor 160. In one embodiment, the positions of the wafer 12 and the pressure sensor 160 are calculated as a function of time by knowing the starting positions and the relative movement between the wafer 12 and the pressure sensor 160. In another embodiment, electronic or optical position indicators (not shown) such as transducers and lasers may be attached to the underpad 125 and the wafer carrier assembly 130 to determine the positions of the wafer 12 and pressure sensor 160. By correlating the signals from the A/D converter 170 with the relative position between the wafer 12 and the pressure sensor 160, the controller 180 determines the contour of the front face 14 of the wafer 12.

The controller 180 is also operatively connected to each of the actuators 150 by a line 152. As will be discussed in detail below, the controller 180 generates and sends signals to selected actuators 150 to deform the wafer 12 into a desired contour that increases the uniformity of the finished surface. A suitable controller 180 is the DAQBOARD data acquisition board manufactured by Omega of Stamford, Connecticut for use in the CMP machine 110.

Returning to FIG. 3, the chuck 131, actuators 150, and pressure sensor 160 of the CMP machine 110 are shown in greater detail. The pressure sensor 160 is preferably positioned in the underpad 125 at a location over which the wafer 12 periodically passes during planarization. In this embodiment of the invention, the actuators 150 are a plurality of circular piezoelectric crystals arranged in concentric circles from a perimeter actuator 150(*a*) to a center actuator 150(*g*). Each of the actuators 150(*a*)–150(*g*) has a fixed end 151 attached to the upper surface of the mounting cavity 132 in the chuck 131 and free end 153 facing the backside 15 of the wafer 12. The actuators 150(*a*)–150(*g*) are preferably positioned within the mounting cavity 132 so that their free ends 153 move substantially normal to the backside 15 of the wafer 12. The deformable plate 135 preferably abuts the free ends 153 of the actuators, and the backing pad 134 is preferably positioned between the backside 15 of the wafer 12 and the deformable plate 135. The deformable plate 135 and the backing pad 134 are both flexible, and thus the displacement of an individual actuator is substantially independently transferred to the local area on the backside 15 of the wafer 12 juxtaposed the free end 153 of the individual actuator. For example, actuator 150(*a*) can expand and thus increase the pressure at the perimeter of the wafer 12, while actuator 150(*g*) can contract and thus reduce the pressure at the center of the wafer 12.

Figure 4A:
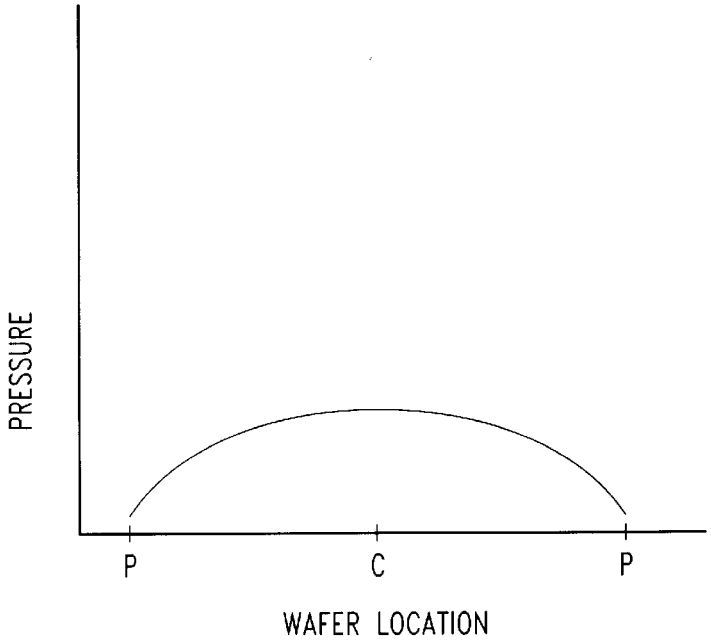
FIG. 4A is a graph illustrating a pressure profile measured by a chemical-mechanical planarization machine in accordance with the invention.

In operation, the chuck 131 presses the wafer 12 against the polishing pad 140, which causes the polishing pad 140 to compress and conform to the contour of the front face 14 of the wafer 12. As the chuck 131 moves in a direction indicated by arrow M, the pressure between the wafer 12 and the polishing pad 140 over the pressure sensor 160 fluctuates corresponding to the contour of the front face 14 of the wafer 12. It will be appreciated that thin areas on the wafer 12 produce a lower pressure relative to thick areas on the wafer 12. The pressure sensor 160 periodically senses the pressure at equal intervals to measure the pressure between the wafer 12 and the polishing pad 140 at a plurality of areas across the wafer. The measured pressure at the areas is correlated with the relative position between the wafer 12 and the pressure sensor 160 over time to determine the contour of the front face 14 of the wafer 12. The pressure sensor 160 also generates a signal that fluctuates according to the measured pressure at areas across the wafer 12. As shown in FIG. 4A, for example, the pressure sensor 160 generates a signal in which the pressure is low at the perimeter of the wafer and high at the center of the wafer corresponding to the contour of the front face 14 of the wafer 12 (shown in FIG. 3).

Figure 4B:
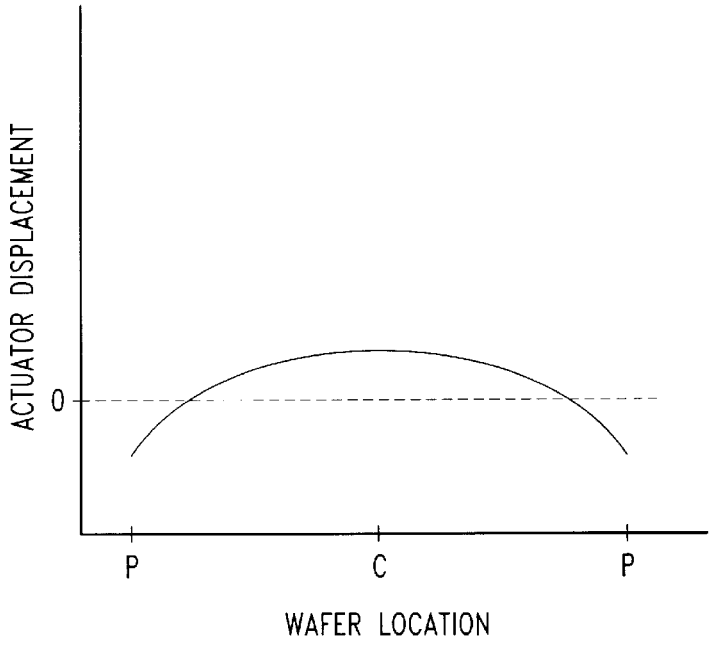
FIG. 4B is a graph of a wafer and actuator profile of an embodiment of a chemical-mechanical planarization machine in accordance with the invention.

The controller 180 processes the signal from the pressure sensor 160 to selectively operate the actuators 150(*a*)–150(*g*). As shown in FIG. 4B, for example, the controller 180 causes the actuators at the perimeter (P) of the wafer 12 to elongate below a reference line (0) and the actuators at the center (C) of the wafer 12 to contract above the reference line (0). As discussed above, the displacement of each actuator is transmitted to the backside 15 of the wafer 12 through the deformable plate 135 and the backing pad 134 to locally adjust the pressure between the wafer 12 and the polishing pad 140.

Figure 5:
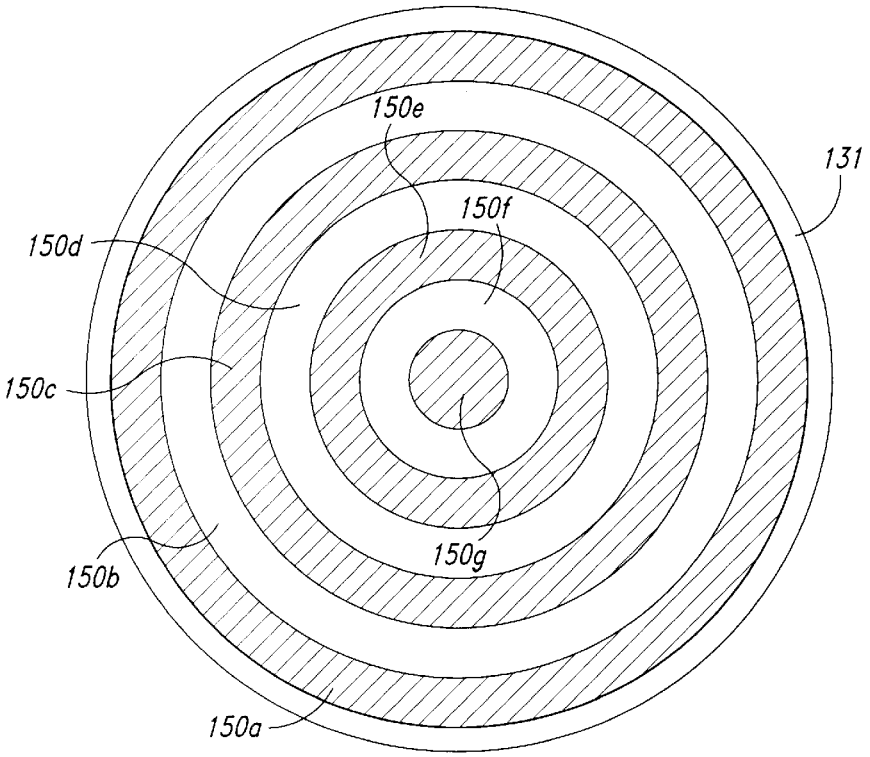
FIG. 5 is a schematic bottom plan view of an embodiment of a wafer carrier assembly of a chemical-mechanical planarization machine in accordance with the invention.
Figure 6:
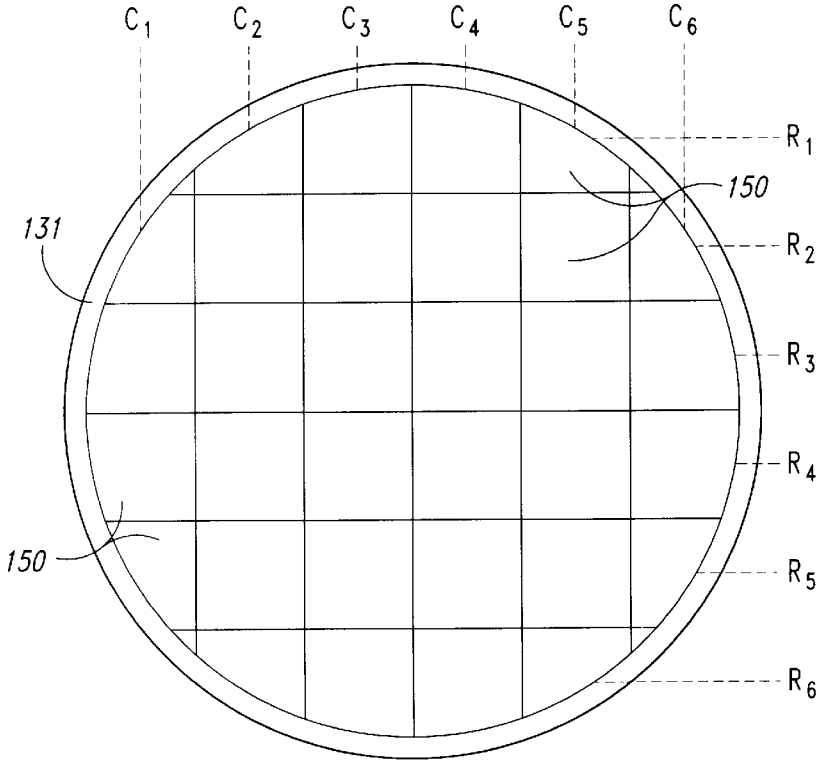
FIG. 6 is a schematic bottom plan view of another embodiment of a wafer carrier of a chemical-mechanical planarization machine in accordance with the invention.

FIGS. 5 and 6 illustrate various patterns of actuators 150 in the mounting socket 132 of the chuck 131. FIG. 5 illustrates the concentrically arranged actuators 150(*a*)–150(*g*) discussed above with respect to FIG. 3. FIG. 6 illustrates a pattern of actuators 150 arranged in columns $C_1$–$C_6$ and rows $R_1$–$R_6$. It will be appreciated that the actuators 150 may be arranged in several different patterns, and thus the invention is not limited to the actuator patterns illustrated in FIGS. 5 and 6.

Figure 7:
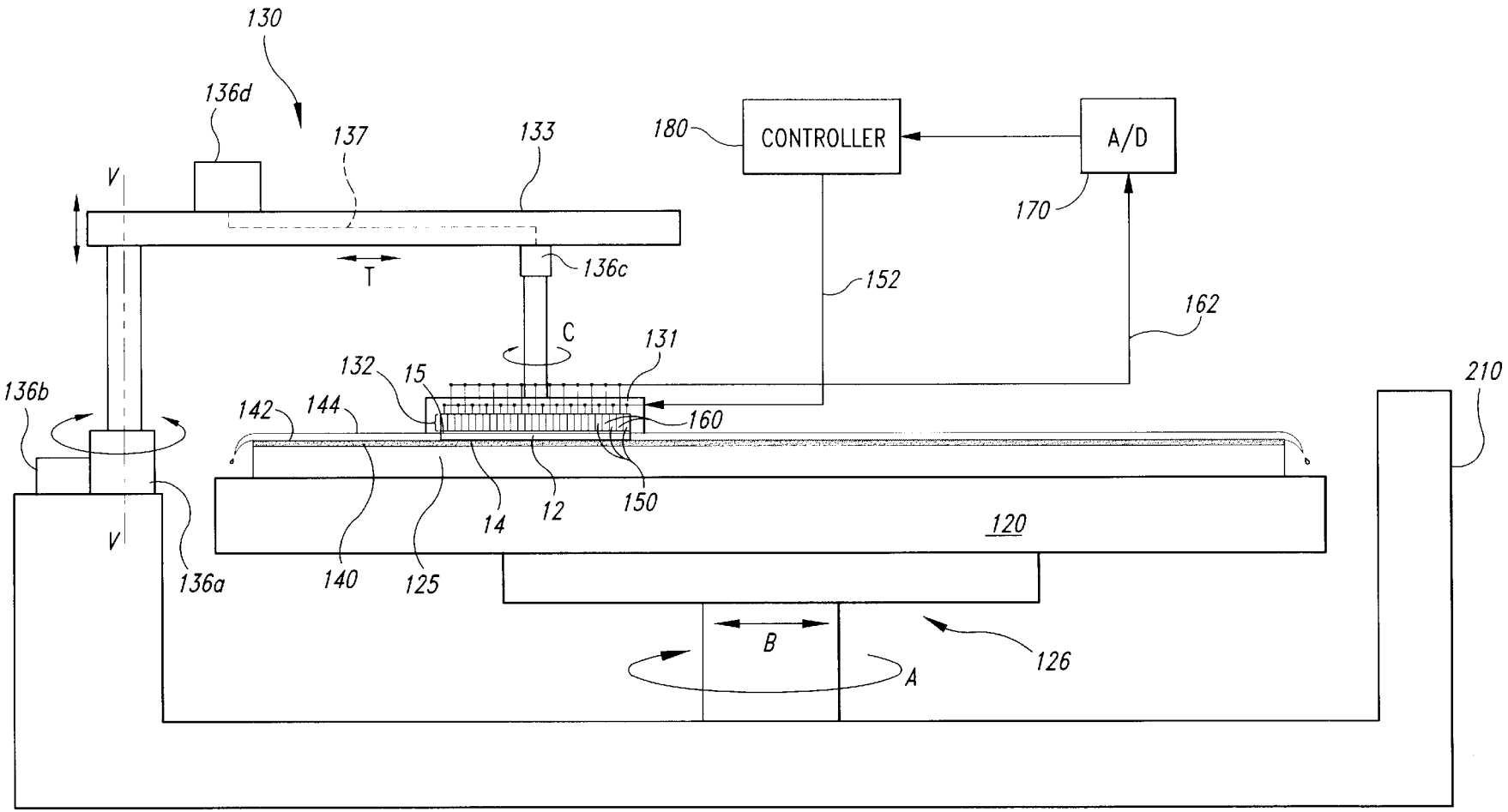
FIG. 7 is a schematic cross-sectional view of another embodiment of a chemical-mechanical planarization machine in accordance with the invention.
Figure 8:
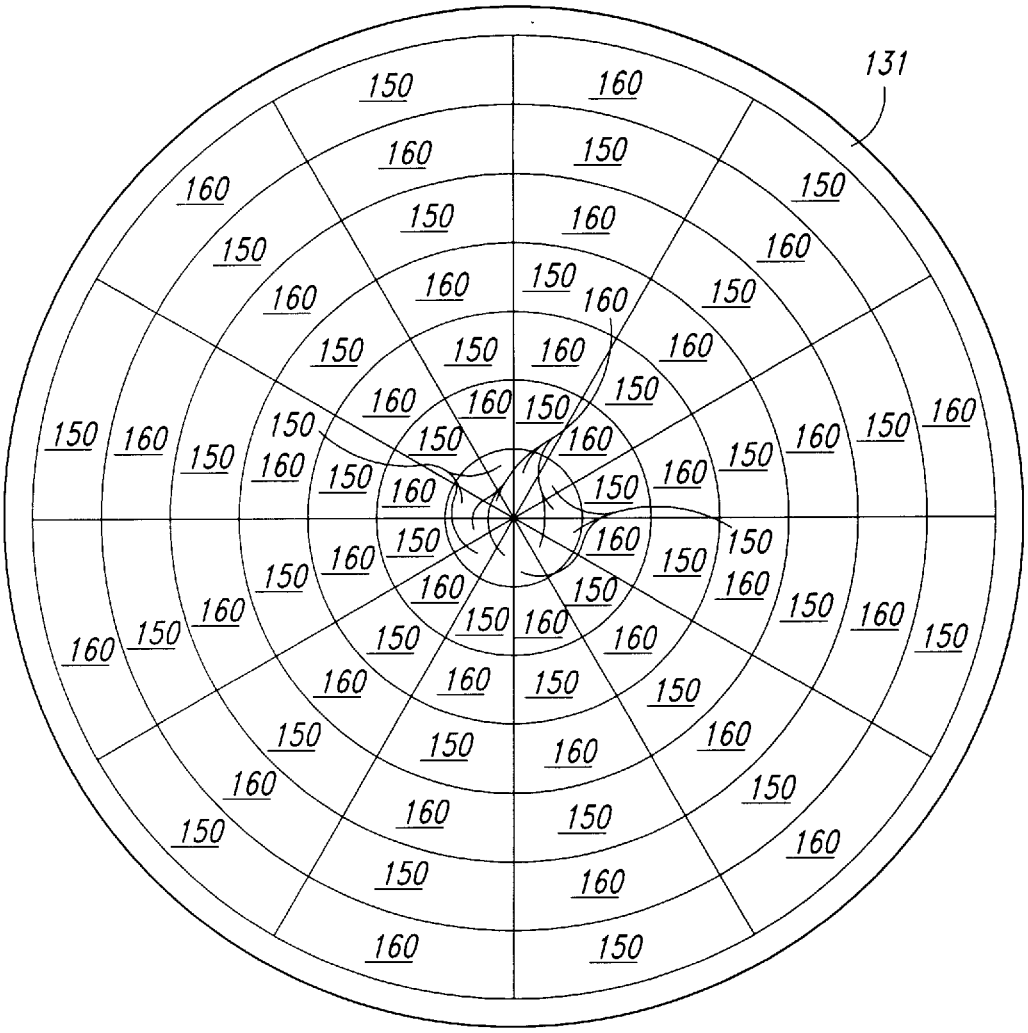
FIG. 8 is a schematic bottom plan view of an embodiment of another wafer carrier assembly of a chemical-mechanical planarization machine in accordance with the invention.

FIG. 7 illustrates another embodiment of a CMP machine 210 in accordance with the invention. As discussed above with respect to FIG. 2, the CMP machine 210 has a wafer carrier assembly 130 with a chuck 131. The CMP machine 210 also has a plurality of actuators 150 and a plurality of pressure sensors 160 positioned in the mounting socket 132 of the chuck 131. As shown in FIG. 8, the actuators 150 and the pressure sensors 160 are preferably arranged in a pattern of concentric circles in which the actuators and pressure sensors alternate with one another radially outwardly and circumferentially within the mounting cavity 132. In another embodiment (not shown), the actuators 150 and the pressure sensors 160 may be arranged in an alternating pattern along X–Y coordinates similar to that shown in FIG. 6. In still another embodiment (not shown), each piezoelectric element may be both an actuator and a sensor such that a signal generated by a specific piezoelectric element may be used by a controller to expand or contract the same element. The pressure sensors 160 are operatively connected to the converter 170 by a line 162, and the actuators 150 are operatively connected to the controller by a line 152.

Still referring to FIG. 7, the CMP machine 210 operates in a similar manner to the CMP machine 110 described above in FIGS. 2 and 3. Unlike the CMP machine 110, however, the CMP machine 210 measures the pressure at a plurality of areas across the backside 15 of the wafer 12 to determine an approximation of the contour of the front face 14 of the wafer 12. An individual pressure sensor 160 generates at the area of the backside 15 of the wafer 12 at which pressure sensor 160 is located. The controller 180 selectively drives the actuators 160 in response to the signals generated by the pressure sensors 160. In a preferred embodiment, the actuators 150 and the pressure sensors 160 are paired together so that each actuator 150 is driven in response to a signal generated by an adjacent pressure sensor 160. The pressure sensors 160 and actuators 150 are preferably made from similar piezoelectric crystals so that the signals generated by each of the pressure sensors 160 may be converted directly into the desired displacement for each of the corresponding actuators 150. Suitable piezoelectric devices that may be used in this embodiment of the invention are the ESA devices manufactured by Newport of Irvine, Calif.

One advantage of the CMP machines 110 and 210 is that they provide control of the planarization process to produce a more uniformly planar surface on semiconductor wafers. Because many factors influence the uniformity of a wafer, it is very difficult to identify variances in the factors that reduce the wafer uniformity. The present invention generally compensates for variations in CMP operating parameters and produces a more uniformly planar surface on a wafer regardless of which factors are irregular. To compensate for irregularities in CMP operating parameters, the present invention controls the planarizing process by measuring the contour of the front face of the wafer and selectively deforming the wafer to change the pressure between areas on the front face of the wafer and the polishing pad. By applying the appropriate pressure at areas across the wafer, high points on the wafer may be planarized faster and low points on the wafer may be planarized slower to enhance the uniformity of the wafer. Therefore, compared to conventional CMP machines and processes, the CMP machines and processes of the present invention control the planarization process to produce a more uniformly planar surface on semiconductor wafers.

Another advantage of the CMP machines 110 and 210 is that they control the planarization process without impacting the throughput of finished wafers. By measuring the contour and selectively deforming the wafer while the wafer is being planarized, the present invention selectively determines and controls the pressure between the wafer and the polishing pad without stopping the CMP process. Therefore, the present invention does not reduce the throughput of finished wafers.

Figure 9:
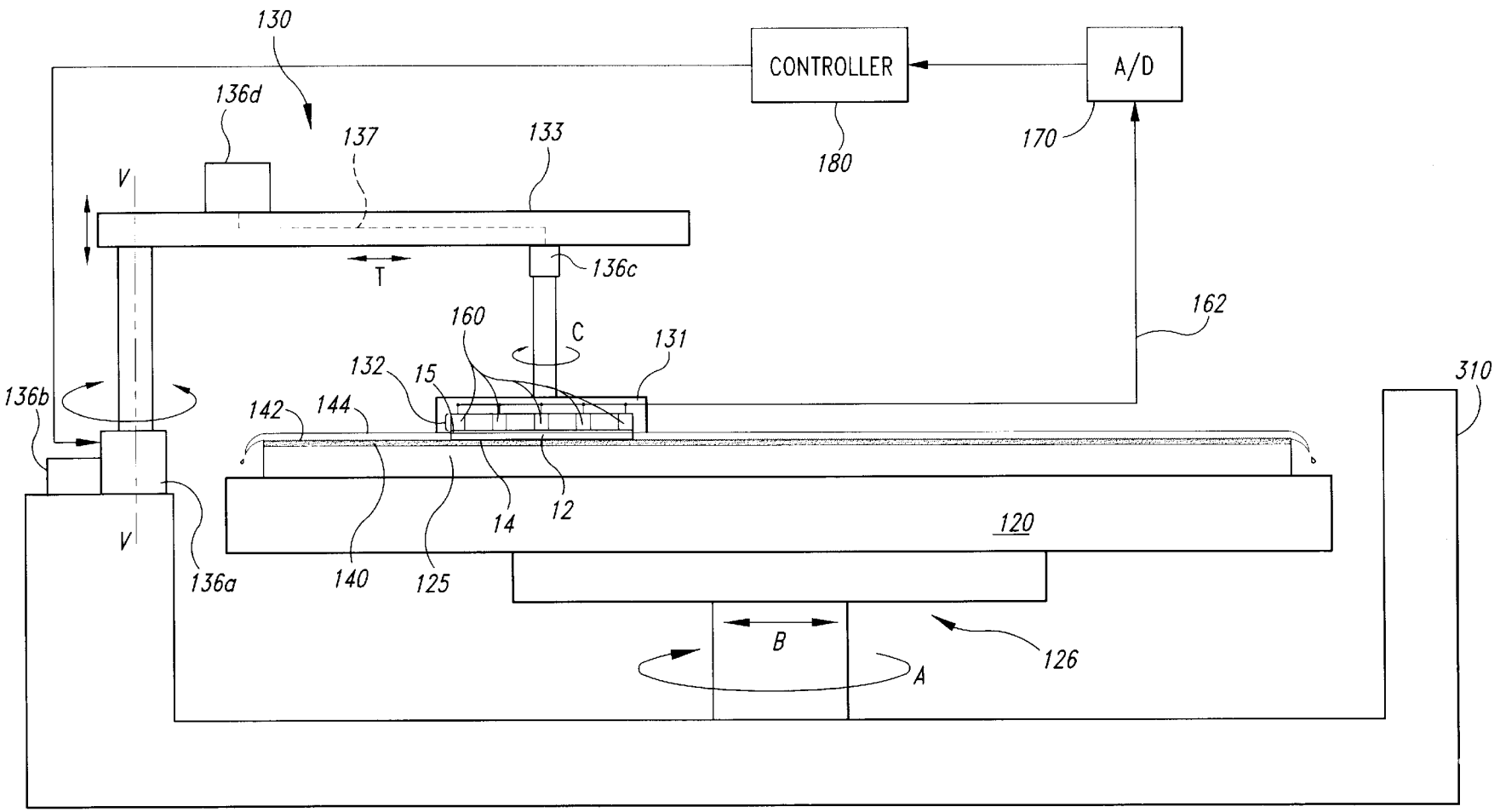
FIG. 9 is a schematic cross-sectional view of another embodiment of a chemical-mechanical planarization machine in accordance with the invention.

FIG. 9 illustrates another embodiment of a CMP machine 310 in accordance with the invention for stopping the planarization process at a desired endpoint. The CMP machine 310 has an actuator assembly 130, a platen 120, and an A/D converter 170 similar to those discussed above with respect to the CMP machines 110 and 210 of FIGS. 2 and 7, respectively. In this embodiment of the invention, the CMP machine 310 has at least one pressure sensor 160 positioned in the mounting socket 132 of the chuck 131, and more preferably a plurality of pressure sensors 160 are positioned in the mounting cavity 132. Each pressure sensor 160 preferably adheres to the backside 15 of the wafer 12 to measure changes in torsional stress on the backside 15 of the wafer 12.

The CMP machine 310 uses the stress measurements on the backside 15 of the wafer 12 to determine endpoint the CMP process. As wafer 12 moves across the planarizing surface 142 of the polishing pad 140, the friction between the wafer 12 and the polishing pad 140 changes. In general, the friction between the wafer 12 and the pad 140 decreases as the front face of the wafer 12 becomes more planar. The friction may also change when the material on the front face of the wafer 12 changes from one material to another. For example, the friction between the wafer 12 and the pad 140 generally increases after a metal layer is planarized down to an oxide layer in the formation of contact plugs or other conduction features. The change in friction between the wafer 12 and the pad 140 generally occurs even when the pressure between the wafer 12 and the pad 140 remains constant. It will be appreciated that the change in friction between the wafer 12 and the pad 140 causes a change in torsional stress in the wafer 12 because the backside 15 of the wafer 12 is substantially adhered to the chuck 131. Additionally, since the sensor 160 is adhered to backside 15 of the wafer 12, the torsional stress of the wafer 12 causes the sensor 160 to deflect and produce a different signal even through the pressure between the wafer 12 and the pad 140 remains constant. Thus, the measured stress on the backside 15 of the wafer 12 is expected to change with decreasing wafer thickness. It is further expected that a relationship between the change in measured stress across the backside of the wafer and an indication of the endpoint on the wafer can be determined empirically.

In the operation of the CMP machine 310, the sensors 160 send a signal to the A/D converter 170 via line 162, and the A/D converter 170 then sends digitized signals to the controller 180. The controller 180 stops planarizing the wafer when the measured stress across the backside 15 of the wafer 12 indicates that the wafer 12 has reached its desired endpoint. The controller 180 is preferably operatively connected to the cylinder 136(*a*) that raises and lowers the arm 133 to simply disengage the wafer 12 from the polishing pad 40 when the wafer 12 has reached its desired endpoint.

An advantage of the CMP machine 310 of the invention is that it stops the CMP process at a desired endpoint without affecting the throughput of finished wafers. Existing endpoint techniques generally stop the CMP process, remove the wafer from the polishing pad, and measure a change in thickness of the wafer. It will be appreciated that stopping the CMP process and removing the wafer from the polishing pad reduces the throughput of finished wafers. In the present invention, the stress across the backside of the wafer, and thus an indication of the endpoint on the wafer, is measured while the wafer is planarized and without removing the wafer from the polishing pad. Therefore, it is expected that the present invention will provide accurate end pointing without affecting the throughput of finished semiconductor wafers.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A planarizing machine for removing material from a semiconductor wafer having a backside and a front face, comprising:

a platen mounted to a support structure;

a polishing pad having a planarizing surface facing away from the platen;

an underpad positioned between the platen and the polishing pad;

a wafer carrier assembly having a chuck with a mounting cavity for holding the backside of the wafer, the wafer carrier assembly being adapted to position the chuck over the polishing pad and to engage the front face of the wafer with the planarizing surface of the polishing pad, wherein at least one of the platen and the chuck moves with respect to the other to impart relative motion between the wafer and the polishing pad; and a pressure sensor positioned below the chuck and configured to measure pressure at a plurality of areas across the front face of the wafer as the at least one of the platen and the chuck moves and while the wafer engages the planarizing surface of the polishing pad, the pressure sensor generating a signal in response to the measured pressure across the wafer that corresponds to a contour of the wafer.

2. The planarizing machine of claim 1, further comprising an underpad, and wherein the pressure sensor is positioned in the underpad so that the wafer passes over the pressure sensor as the wafer is planarized, the pressure sensor measuring the pressure at a plurality of areas across the front face of the wafer as the wafer passes over the pressure sensor, and whereby the signal generated by the pressure sensor corresponds to a contour of the front face of the wafer.

3. The planarizing machine of claim 2 wherein the pressure sensor is a piezoelectric sensor.

4. The planarizing machine of claim 1, further comprising an underpad, and wherein the pressure sensor is positioned between the underpad and the polishing pad so that the wafer passes over the pressure sensor as the wafer is planarized, the pressure sensor measuring the pressure at a plurality of areas across the front face of the wafer as the wafer passes over the pressure sensor, and whereby the signal generated by the pressure sensor corresponds to a contour of the front face of the wafer.

5. The planarizing machine of claim 1 wherein the pressure sensor is positioned in the polishing pad so that the wafer passes over the pressure sensor as the wafer is planarized, the pressure sensor measuring the pressure at a plurality of areas across the front face of the wafer as the wafer passes over the pressure sensor, and whereby the signal generated by the pressure sensor corresponds to a contour of the front face of the wafer.

6. A planarizing machine for removing material from a semiconductor wafer having a backside and a front face, comprising:

a platen mounted to a support structure;

a polishing pad having a planarizing surface facing away from the platen;

an underpad positioned between the platen and the polishing pad;

a wafer carrier assembly having a chuck with a mounting cavity in which the backside of the wafer is positioned, the wafer carrier assembly positioning the chuck over the polishing pad and engaging the front face of the wafer with the planarizing surface of the polishing pad, wherein at least one of the platen and the chuck moves with respect to the other to impart relative motion between the wafer and the polishing pad;

a pressure sensor positioned below the chuck and configured to measure pressure at a plurality of areas across the front face of the wafer as the at least one of the platen and the chuck moves and while the wafer engages the planarizing surface of the polishing pad, the pressure sensor generating a signal in response to the measured pressure across the wafer that corresponds to a contour of the wafer; and a controller operatively connected to the pressure sensor, the controller controlling an operating parameter of the planarizing machine in response to the measured pressure.

7. The planarizing machine of claim 6, further comprising an underpad positioned between the platen and the polishing pad.

8. The planarizing machine of claim 7 wherein the pressure sensor is positioned in the underpad so that the wafer passes over the pressure sensor as the wafer is planarized, the pressure sensor measuring pressure at a plurality of areas across the front face of the wafer so that the signal generated by the sensor corresponds to a contour of the front face of the wafer, and wherein the planarizing machine further comprises a plurality of actuators operatively connected to the controller and positioned in the mounting cavity of the chuck to deform the wafer, the controller selectively driving each actuator toward or away from the backside of the wafer to selectively deform the wafer in response to the contour of the front face of the wafer.

9. The planarizing machine of claim 8 wherein the plurality of actuators comprises a plurality of piezoelectric drivers arranged in a first pattern in the mounting cavity of the chuck and the pressure sensor comprises a plurality of piezoelectric sensors arranged in the first pattern in the underpad, the plurality of piezoelectric sensors generating a plurality of signals that correspond to the contour of the front side of the wafer, and wherein the controller correlates the plurality of signals from the piezoelectric sensors so that a signal from a piezoelectric sensor at a location in the first pattern controls a piezoelectric driver at the same location in the first pattern and generates a plurality of control signals to move each piezoelectric driver a distance related to a pressure sensed by a corresponding piezoelectric pressure sensor.

10. The planarizing machine of claim 9 wherein the piezoelectric pressure sensors and drivers are arranged in a similar pattern of rows and columns.

11. The planarizing machine of claim 9 wherein the piezoelectric sensors and drivers are arranged in a similar pattern of concentric circles.

12. The planarizing machine of claim 7 wherein the pressure sensor is positioned in the underpad so that the wafer passes over the pressure sensor as the wafer is planarized, the pressure sensor measuring pressure at a plurality of areas across the front face of the wafer so that the signal generated by the sensor corresponds to a contour of a front face of the wafer, and wherein the planarizing machine further comprises a plurality of actuators operatively connected to the controller and positioned in the mounting cavity of the chuck to deform the wafer, the controller selectively driving each actuator toward and away from the backside of the wafer to selectively deform the wafer in response to the contour of the front face of the wafer.

13. A method of chemical-mechanical planarization of a semiconductor wafer having a backside and a front face, the method comprising the steps of:

pressing the front face of the wafer against a planarizing surface of a polishing pad;

moving at least one of the wafer and the polishing pad with respect to the other to impart relative motion therebetween and to remove material from the front face of the wafer;

measuring pressure at a plurality of areas across the front face of the wafer as the at least one of the wafer and the polishing pad moves and the front face of the wafer is pressed against the planarizing surface, the measured pressure corresponding to a contour of the wafer; and controlling a planarizing parameter in response to the measured pressure at the area.

14. The method of claim 13 wherein the measuring step comprises translating the wafer over a pressure sensor positioned in an underpad of a planarizing machine, the pressure sensor measuring a contour of the front face of the wafer.

15. The method of claim 14 wherein the controlling step comprises selectively driving actuators positioned to act against the backside of the wafer in response to the measured contour of the front face of the wafer.

16. The method of claim 13 wherein the measuring step comprises translating the wafer over a pressure sensor positioned in a polishing pad of a planarizing machine, the pressure sensor measuring a contour of the front face of the wafer.

17. The method of claim 16 wherein the controlling step comprises selectively driving actuators positioned to act against the backside of the wafer in response to the measured contour of the front face of the wafer.

18. The method of claim 13 wherein the measuring step comprises sensing stress on the backside of the wafer with a plurality of piezoelectric sensors positioned in a mounting cavity of a chuck of a planarizing machine, the piezoelectric sensors indicating an endpoint of the wafer.

19. The method of claim 18 wherein the controlling step comprises stopping at least one of the pressing and moving steps when the sensors indicate the wafer is at a desired endpoint.

* * * * *